United States Patent [19]

Scouten

[11] Patent Number: 5,069,191

[45] Date of Patent: Dec. 3, 1991

[54] FUEL AGITATING DEVICE FOR INTERNAL COMBUSTION ENGINE

[76] Inventor: Douglas G. Scouten, 662 Chilton Ave., Niagara Falls, N.Y.

[21] Appl. No.: 547,806

[22] Filed: Jul. 2, 1990

[51] Int. Cl.[5] ..... F02M 33/00

[52] U.S. Cl. ..... 123/538; 123/537; 138/37

[58] Field of Search ..... 123/538, 537, 536; 138/37

[56] References Cited

U.S. PATENT DOCUMENTS

| | | | |
|---|---|---|---|
| 4,237,836 | 12/1980 | Tanasawa et al. | 123/537 |
| 4,251,031 | 2/1981 | Martin et al. | 123/538 |
| 4,590,915 | 5/1986 | Yamauchi et al. | 123/538 |
| 4,930,483 | 6/1990 | Jones | 123/538 |

*Primary Examiner*—Andrew M. Dolinar
*Assistant Examiner*—M. Macy
*Attorney, Agent, or Firm*—Joseph P. Gastel

[57] ABSTRACT

A fuel agitating device for an internal combustion engine including a casing, an inlet conduit in the casing, an outlet conduit in the casing, a chamber between the inlet and outlet conduits, a wedge-shaped divider in the chamber of gradually increasing cross sectional area between the inlet conduit and the outlet conduit, grooves on the wedge-shaped member, an enlarged chamber portion between the outlet conduit and the wedge-shaped member, and a flanged member having alternate ridges and grooves located in coaxial relationship to the outlet conduit and located between the enlarged chamber portion and the outlet conduit.

30 Claims, 1 Drawing Sheet

FUEL AGITATING DEVICE FOR INTERNAL COMBUSTION ENGINE

BACKGROUND OF THE INVENTION

The present invention relates to a fuel agitating device for supplying fuel to an internal combustion engine in such a manner that it causes the engine emissions of carbon monoxide and hydrocarbon to be substantially reduced.

It is well known that internal combustion engines emit pollutants, namely, carbon monoxide and hydrocarbons. It is with a device which reduces the emissions of carbon monoxide and hydrocarbons that the present invention is concerned.

SUMMARY OF THE INVENTION

It is one object of the present invention to provide a fuel agitating device for an internal combustion engine which can be retrofitted into an existing fuel inlet line and which will cause the carbon monoxide and hydrocarbon emissions from the engine to be substantially reduced.

Another object of the present invention is to provide a fuel agitating device which achieves the foregoing objects and which can be fabricated by simple machining operations. Other objects and attendant advantages of the present invention will readily be perceived hereafter.

The present invention relates to an agitator for fuel being conducted to an internal combustion engine comprising a casing, a fuel inlet conduit in said casing, a fuel outlet conduit in said casing, a chamber within said casing between said fuel inlet conduit and said fuel outlet conduit, said chamber including an entry portion proximate said fuel inlet conduit and an exit portion proximate said fuel outlet conduit, and flow divider means having a first divider portion in said chamber facing said entry portion and a second divider portion in said chamber facing said exit portion for dividing said chamber into two fuel flow paths of decreasing cross sectional area on opposite sides thereof.

The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5, 6:
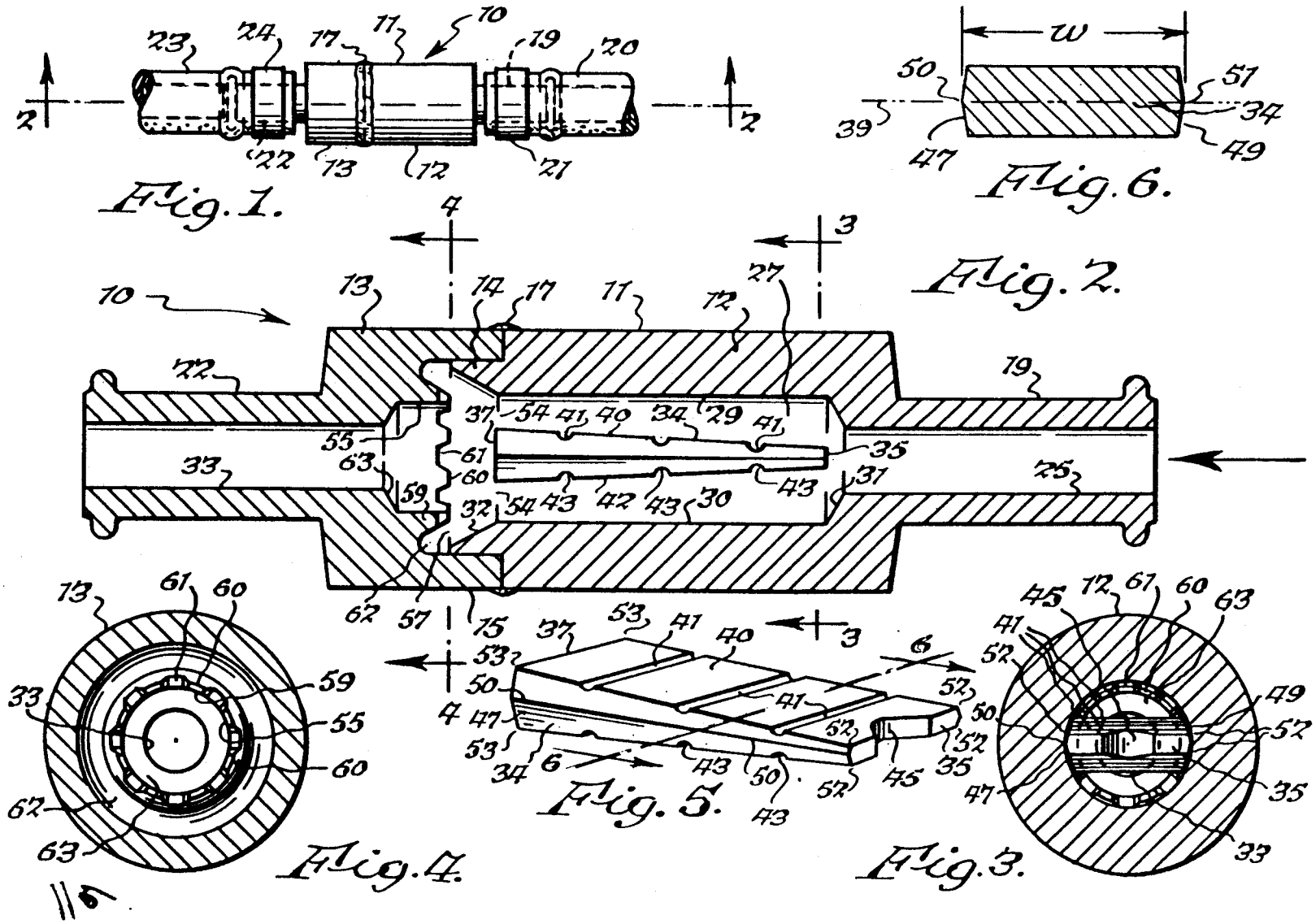
FIG. 1 is a fragmentary plan view of the fuel agitating device of the present invention.
FIG. 2 is an enlarged cross sectional view taken substantially along line 2—2 of FIG. 1.
FIG. 3 is a cross sectional view taken substantially along line 3—3 of FIG. 2.
FIG. 4 is a cross sectional view taken substantially along line 4—4 of FIG. 2.
FIG. 5 is a perspective view of the insert within the housing of the unit.
FIG. 6 is a cross sectional view taken substantially along line 6—6 of FIG. 5.

Summarizing in advance, the fuel agitating device 10 of the present invention is intended to cause fuel supplied to a gasoline engine to be burned more efficiently by causing the emissions of carbon monoxide and hydrocarbons to be substantially reduced.

The fuel agitating device 10 includes a casing 11 which is fabricated in two parts, namely, inlet portion 12 and outlet portion 13. Inlet portion 12 terminates at annular flange 14 which is received with a sliding fit within annular end 15 of outlet portion 13. Inlet portion 12 and outlet portion 13 are secured to each other by an annular weld 17. Inlet portion 12 includes a nipple extension 19 onto which a gasoline conduit 20 is mounted and secured thereto by hose clamp 21. Outlet portion 13 includes an outlet nipple 22 on which hose 23 is mounted and secured thereto by hose clamp 24. Conduit 25 in nipple extension 19 leads into chamber 27 which is defined in part by wall 29 which includes a cylindrical portion 30, a frustoconical portion 31 proximate conduit 25 and a flared-out portion 32. Conduit 33 in outlet nipple 22 is in communication with the portion of chamber 27 adjacent thereto. Thus, chamber 27 includes an entry portion adjacent inlet conduit 25, an exit portion adjacent outlet conduit 33, and a central portion therebetween. The outlet of casing 11 should be as close as possible to the carburetor or fuel injector and preferably not more than 6 inches therefrom.

A wedge-like member 34, which has a narrow end 35 and a wide end 37, is located in chamber 27. It is symmetrical along a central longitudinal plane 39 (FIG. 6). It has an upper surface 40 with a plurality of grooves 41 therein and a lower surface 42 with a plurality of grooves 43 therein. The narrow end 35 of wedge 34 has a curved cutout 45 therein so that end 35 does not unduly obstruct the end of conduit 25. Wedge-like member 34 has V-shaped side walls 47 and 49 which terminate at edges 50 and 51, respectively. Wedge 34 is self-centering during its insertion into chamber 27, and it thus divides chamber 27 into two equal portions in its installed position. In this respect, the width w between edges 50 and 51 is uniform throughout the length of wedge 34 and the width w is a few thousandths of an inch larger than the internal diameter of cylindrical portion 30. Wedge 34 is driven into the position shown. Since wedge 34 is made of a material which is harder than brass, in this instance hardened aluminum, and since casing 11 is made of brass, the edges 50 and 51 of wedge 34 will form mating grooves in wall 29 as they contact it while wedge 34 is being driven into position. Ends 35 and 37 are preferably dimensioned so that their corners 52 and 53, respectively, engage wall 29, or at least are very close thereto.

The volume of chamber 27 immediately adjacent the outlet of conduit 25 is greater than the cross sectional area of the latter, and therefore the fuel will slow down when it enters frustoconical portion 31 and the adjacent portion of chamber 27. In addition, as it hits the end 35 and curved cutout 45, the fuel will become agitated. It will also be agitated as it passes along surfaces 40 and 42. Furthermore as the fuel passes toward outlet nipple 22 through the spaces between the cylinder wall 29 and wedge surfaces 40 and 42, the fuel will increase in velocity because the volume of chamber 27 is constricted by wedge 34.

After the fuel leaves the spaces 54 on the opposite sides of wedge end 35, it enters a chamber portion of larger volume defined by frustoconical portion 32, and thus there is a decrease in the velocity of the fuel. A portion of the fuel then directly enters cylindrical duct 55 which leads to conduit 33 in nipple 22. Another portion of the fuel passes through annular throat 57 between frustoconical surface 32 and flange 59, which is of an interrupted shape having ridges 60 and slots or grooves 61 therebetween. It then passes into annular dead end chamber 62 from which it bounces back through the slots 61 between ridges 60, which form the flange 59 of interrupted shape, and the fuel thereafter enters the conduit 55 leading to frustoconical portion 63 which is adjacent to nipple conduit 33. Thus, the fuel passing through slots 61 and passing by ridges 60 becomes agitated, and, as it passes through frustoconical portion 63, it increases in velocity It is believed that the agitation and mixing action of the fuel causes violent molecular vibrations leading to a greater displacement of the atoms from their equilibrium lattice positions thereby placing the fuel, which is still in a liquid state, close to a vapor state, but ready to be vaporized in the engine. It is believed that this action causes the engine to operate much more efficiently and thus lowering the exhaust emissions of carbon monoxide and hydrocarbons.

In actual tests, the following results were observed when the agitating device 10 of the present invention was installed on a 1989 Plymouth 4-door sedan having a 2.2 liter 4-cylinder engine:

| | EMISSION TEST | |
|---|---|---|
| | CO EMISSION | HYDROCARBON EMISSION |
| | WITHOUT AGITATOR | |
| LOW RPM | .34% | 236 PPM |
| HIGH RPM | .16% | 217 PPM |
| | WITH AGITATOR | |
| LOW RPM | .03% | 5 PPM |
| HIGH RPM | .00% | 3 PPM |

The drawings are to scale. In the device shown in the drawings chamber 27 is 5/16 of an inch in diameter. It will be appreciated that the other parts are of a proportional size. It will also be appreciated that departures can be made from the above noted measurements within the scope of the present invention.

While a preferred embodiment of the present invention has been disclosed, it will be appreciated that it is not limited thereto but may be otherwise embodied within the scope of the following claims.

What is claimed is:

1. An agitator for fuel being conducted to an internal combustion engine comprising a casing, a fuel inlet conduit in said casing, a fuel outlet conduit in said casing, a chamber within said casing between said fuel inlet conduit and said fuel outlet conduit, said chamber including an entry portion proximate said fuel inlet conduit and an exit portion proximate said fuel outlet conduit and a central portion between said entry portion and said exit portion, flow divider means having a first divider portion in said entry portion and a second divider portion in said central portion for dividing said entry portion and said central portion into two fuel flow paths on opposite sides thereof, an inner wall in said casing defining said exit portion, flange means on said casing spaced radially inwardly from said inner wall and located between said second divider portion and said exit portion, and conduit means within said flange means for conducting fuel to said outlet conduit.

2. An agitator as set forth in claim 1 wherein said flow divider means comprises a wedge-shaped member having a thin end located in said entry portion and a portion of increased cross sectional area in said central portion, said divider means being of a width which is substantially equal to the diameter of said chamber.

3. An agitator as set forth in claim 2 wherein said divider means divides said entry portion and said central portion into substantially equal portions.

4. An agitator as set forth in claim 3 including opposite sides on said divider means, and groove means on at least one of said opposite sides.

5. An agitator as set forth in claim 4 including groove means on both of said opposite sides extending crosswise of said divider means.

6. An agitator as set forth in claim 5 wherein said groove means comprise a plurality of grooves on each of said opposite sides.

7. An agitator as set forth in claim 1 wherein said flange means comprise a plurality of spaced members with slots therebetween.

8. An agitator as set forth in claim 1 wherein said exit portion includes a portion which flares outwardly from said central portion.

9. An agitator as set forth in claim 8 wherein said exit portion is substantially frustoconical.

10. An agitator as set forth in claim 8 wherein said flange means is located proximate said portion of said exit portion which flares outwardly.

11. An agitator as set forth in claim 10 wherein said second divider portion is axially spaced from said flange means.

12. An agitator as set forth in claim 8 including an annular chamber which surrounds said flange means and is axially spaced from said portion which flares outwardly from said central portion.

13. An agitator as set forth in claim 12 wherein said annular chamber includes an outer wall and an inner wall which is the outer surface of said flange means.

14. An agitator as set forth in claim 13 wherein said outer wall is substantially cylindrical, and wherein said outer surface of said flange means is frustoconical with its smaller end facing said divider means.

15. An agitator as set forth in claim 14 wherein said flange means comprises a plurality of teeth-like members with slots therebetween.

16. An agitator for fuel being conducted to an internal combustion engine comprising a casing, a fuel inlet conduit in said casing, a fuel outlet conduit in said casing, a chamber within said casing between said fuel inlet conduit and said fuel outlet conduit, said chamber including an entry portion proximate said fuel inlet conduit and an exit portion proximate said fuel inlet conduit and an exit portion proximate said fuel outlet conduit, and flow divider means having a first divider portion in said chamber facing said entry portion and a second divider portion in said chamber facing said exit portion for dividing said chamber into two fuel flow paths of progressively decreasing cross sectional area extending axially within said casing on opposite sides of said flow divider means.

17. An agitator as set forth in claim 16 wherein said flow divider means comprise a member of increasing cross sectional dimension extending from said first divider portion toward said second divider portion.

18. An agitator as set forth in claim 17 wherein said divider means are of a width which is substantially equal to the diameter of said chamber.

19. An agitator as set forth in claim 17 wherein said divider means divides said entry portion and said central portion into substantially equal portions.

20. An agitator as set forth in claim 17 wherein said divider means has opposite sides, and groove means on at least one of said opposite sides.

21. An agitator as set forth in claim 20 wherein said divider means has an axis which extends lengthwise between said fuel inlet and outlet conduits, and wherein said groove means extend crosswise to said axis.

22. An agitator as set forth in claim 21 wherein said groove means are on both of said opposite sides.

23. An agitator as set forth in claim 17 wherein said divider means divides said chamber into two substantially equal portions.

24. An agitator for fuel being conducted to an internal combustion engine comprising a casing, a fuel inlet conduit in said casing, a fuel outlet conduit in said casing, a chamber in said casing between said fuel inlet conduit and said fuel outlet conduit, a first portion in said chamber proximate said fuel inlet conduit of greater cross sectional area than said fuel inlet conduit, a second portion in said chamber of progressively decreasing cross sectional area relative to said first portion, said second portion extending axially of said chamber between said fuel inlet conduit and said fuel outlet conduit, said second portion being located on the opposite side of said first portion from said inlet conduit, a third portion in said chamber of increasing cross sectional area relative to said second portion adjacent thereto, said third portion being located on the opposite side of said second portion from said first portion, and a fourth portion proximate said fuel outlet conduit of smaller cross sectional area than said third portion.

25. An agitator as set forth in claim 24 including flange means surrounding said fourth portion.

26. An agitator as set forth in claim 25 wherein said fourth portion is of larger cross sectional area than said outlet conduit.

27. An agitator as set forth in claim 25 including an annular chamber portion surrounding said flange means.

28. An agitator as set forth in claim 27 wherein said flange means comprises alternate grooves and ridges.

29. An agitator as set forth in claim 1 wherein said flange means is located radially inwardly of a dead end chamber proximate said exit portion.

30. An agitator as set forth in claim 29 wherein said flange means comprises a plurality of spaced members with slots therebetween.

* * * * *

UNITED STATES PATENT AND TRADEMARK OFFICE

CERTIFICATE OF CORRECTION

PATENT NO. : 5,069,191

DATED : December 3, 1991

INVENTOR(S) : Douglas G. Scouten

It is certified that error appears in the above-identified patent and that said Letters Patent is hereby corrected as shown below:

Column 4, lines 50 and 51 (claim 16), delete "inlet conduit and an exit portion proximate said fuel".

Signed and Sealed this

Sixteenth Day of March, 1993

*Attest:*

STEPHEN G. KUNIN

*Attesting Officer*

*Acting Commissioner of Patents and Trademarks*